United States Patent [19]

Firth

[11] Patent Number: 4,988,239

[45] Date of Patent: Jan. 29, 1991

[54] MULTIPLE-CHOKE APPARATUS FOR TRANSPORTING AND METERING PARTICULATE MATERIAL

[75] Inventor: Donald Firth, Devon, England

[73] Assignee: Stamet, Inc., Santa Monica, Calif.

[21] Appl. No.: 488,314

[22] Filed: Mar. 5, 1990

[51] Int. Cl.[5] ..... B65G 31/04

[52] U.S. Cl. ..... 406/99; 198/617; 198/642; 198/723; 415/90; 406/197

[58] Field of Search ..... 406/96, 99, 197; 415/90, 126; 198/617, 639, 642, 718, 723

[56] References Cited

U.S. PATENT DOCUMENTS

| | | | |
|---|---|---|---|
| 2,045,081 | 6/1936 | Hart | 198/128 |
| 2,196,390 | 4/1940 | Gates | 198/128 |
| 2,205,902 | 6/1940 | McMahan | 230/133 |
| 2,318,881 | 5/1943 | Mundy | 198/128 |
| 2,568,536 | 9/1951 | Beech | 22/36 |
| 2,626,571 | 1/1953 | Hoenecke | 103/135 |
| 2,637,375 | 5/1953 | Tapp et al. | 158/42.2 |
| 2,843,047 | 7/1958 | Korber | 103/84 |
| 2,868,351 | 1/1959 | Hegmann | 198/128 |
| 3,086,696 | 4/1963 | Heine-Geldern | 230/42 |
| 3,150,815 | 9/1964 | Laing | 230/42 |
| 3,765,216 | 10/1973 | Green | 72/262 |
| 3,889,588 | 6/1975 | Wollersheim | 100/177 |
| 4,032,254 | 6/1977 | Bentz et al. | 415/54 |
| 4,177,005 | 12/1979 | Bozung et al. | 415/128 |
| 4,193,737 | 3/1980 | Lemmon | 406/99 |
| 4,335,994 | 6/1982 | Girth | 406/99 |
| 4,409,746 | 10/1983 | Beck | 406/96 |
| 4,516,674 | 5/1985 | Firth | 198/617 |
| 4,616,961 | 10/1986 | Burrough et al. | 406/99 |
| 4,678,076 | 7/1987 | Nenakhov et al. | 198/525 |

FOREIGN PATENT DOCUMENTS

| | | | |
|---|---|---|---|
| 725012 | 5/1932 | France | 406/99 |
| 1220175 | 2/1968 | United Kingdom . | |
| 1379075 | 1/1972 | United Kingdom . | |

*Primary Examiner*—Sherman Basinger
*Assistant Examiner*—Stephen P. Avila
*Attorney, Agent, or Firm*—Poms, Smith, Lande & Rose

[57] ABSTRACT

A multiple-choke unit for transporting and metering particulate material wherein the material is compacted to bridging, disturbed and then recompacted as it is friction driven through a duct. The duct has two opposed walls moving between the inlet and outlet which have a surface area that is larger than the surface area of a stationary wall or walls which from the other part of the duct. The duct includes a plurality of chokes which bridge by compaction, disturb and recompact the material as it is friction-driven through the unit. The unit provides simultaneous transport and metering of particulate material. The unit may be used to transport particulate material under atmospheric conditions or into a pressurized system.

15 Claims, 2 Drawing Sheets

MULTIPLE-CHOKE APPARATUS FOR TRANSPORTING AND METERING PARTICULATE MATERIAL

BACKGROUND OF THE INVENTION

1. Field of the Invention

The present invention relates generally to apparatus and methods for transporting and metering particulate material. More particularly, the present invention is directed to a particulate material handling device which can be used to both transport and meter either large or small amounts of solid material of a great range of sizes.

2. Description of Related Art

A wide variety of equipment has been used to either transport or meter particulate material. Such transport equipment includes conveyor belts, rotary valves, lock hoppers, screw-type feeders, etc. Exemplary measurement or metering devices include weigh belts, volumetric hoppers and the like. In order to provide both transport and metering of particulate material, it is generally necessary to have both types of devices present in the system.

One or more of the above transport or metering devices may be used in a solids transport system, depending upon a wide variety of parameters. For example, the amount, size and type of particulate material to be transported must be taken into consideration. The distance over which the solids are to be transported and variations in the surrounding pressure during transport must also be taken into account. The various transport and metering systems which are presently in use all have a variety of advantages and disadvantages which limit their performance in transporting or metering a wide variety of particulate types. It would be desirable to provide a single unit which is capable of simultaneously transporting and metering a wide variety of particulate materials under both ambient and pressurized conditions.

Large scale transport and/or metering of coal presents unique problems. A transport apparatus or system which is suitable for transporting one type of coal may not be suitable for transporting a different type of coal. For example, Kentucky coals maintains reasonable integrity when transported through conventional devices such as screw feeders and conveyor belts. However, Western United States coals tend to be more friable and may be degraded to a significant degree during normal transfer operations. It would be desirable to provide an apparatus which is capable of transferring all types of coal with a minimum amount of degradation.

The water content of the particulate solids is another factor which must be considered when designing any transport system. Many transport devices which are suitable for transporting completely dry particles do not function properly when the moisture content of the particulate material is raised. The same is true for particulate metering devices. Conventional metering devices which are designed to measure dry particulates are not well suited to meter moist solids. It would be desirable to provide a transport apparatus which is capable of moving and/or metering particulate solids regardless of their moisture content.

There are also many instances in which it is desirable to transport and meter particulate materials against pressure. It would be desirable to provide an apparatus which is capable of simultaneously pumping and metering under both ambient pressure conditions and against a pressure head caused either by entry into a pressurized system or transport of the particulate material upward against gravity.

It is apparent from the above background that there is a present need for a solids handling or pumping device which operates as a single unit to provide simultaneous transport and metering of particulate material. The unit should be capable of transporting and metering a wide variety of particle types under a wide variety of conditions. Further, the unit should be structurally strong, and mechanically simple and durable so that it can be operated continuously over extended periods of time without failure.

SUMMARY OF THE INVENTION

In accordance with the present invention, an apparatus and method is provided for transporting and metering particulate materials with increased efficiency and reliability. The solids pump of the present invention is useful, not only in transporting and metering particulates under ambient pressure conditions, but is also useful in transporting and metering solids into pressurized systems. Further, the apparatus may be used to transport a wide range of particulate materials, including both small and large particulates, and mixtures of them, having varying degrees of moisture content.

The present invention is based on the discovery that a wide variety of particulate material may be transported and metered through a duct or passageway by friction forces provided that the particles are bridged by compression, disturbed and then recompressed as they pass through the duct. The bridging of material is accomplished by reducing the cross-sectional area of the duct to form a first convergence or choke. The first choke is followed by an increase in duct cross-sectional area which disturbs the relationship of the particles. In accordance with the present invention, the cross-sectional area is then re-reduced, renewing compression of the particles before they exit the pump. The solids pump operates as a valveless positive displacement pump which provides accurate metering of particulates as well as transport under ambient conditions and against pressure.

The solids pump of the present invention includes a housing having an inlet, an outlet and a duct between the inlet and outlet. The duct is formed or defined by two opposed friction drive walls and one or more stationary walls. The friction drive walls are movable relative to the pump housing from the inlet toward the outlet, while the stationary walls are fixed relative to the pump housing with respect to movement between the inlet and outlet. The friction drive walls must have a greater surface area for contacting the particulate material than the stationary walls.

In accordance with the present invention, the duct includes a first choke for bridging the particulate material after introduction into the inlet. The first choke includes a convergence of the friction drive walls with the stationary wall to provide a first portion of the duct having a cross-sectional area which is less than the cross-sectional area of the inlet. The pump further includes at least a second choke which first provides an increase in the cross-sectional area of the duct from that of the first choke, but less than that of the pump inlet, so as to disturb the relationship among the particles, and then renews the reduction of the cross-sectional area of the duct approximately to that of the first portion of the duct. The second choke includes a divergence of the friction drive walls from the stationary walls to provide a second portion of the duct having a cross-sectional area which is greater than the cross-sectional area of the first portion of the passageway, but less than the cross-sectional area of the housing inlet. A third portion of the passageway is also provided in the second choke wherein the friction drive walls and stationary walls reconverge to provide a cross-sectional area approximately equal to that of the first portion of the duct prior to exit out of the outlet. It was discovered that the multiple choking of particulate material within the pump duct provides a uniform and positive displacement of solids through the duct which is well suited for both metering and transporting the particulate material under a variety of conditions.

As a feature of the present invention, the rate at which the friction drive walls and stationary wall converge to form the various chokes may be varied. This allows fine tuning of the apparatus with respect to different types of materials being conveyed. As another feature of the present invention, the duct is defined by the outer edge of a rotor disk which is rotatable within the housing. The rotor disk assembly includes one or more U-shaped grooves having opposed interior faces which define the friction drive walls. A radially exterior stationary wall is fixed to the housing and forms the outer stationary wall. The stationary wall is a unitary structure which is shaped to provide the variations in duct cross-sectional area necessary for the various chokes in accordance with the present invention. Alternatively, the stationary wall is made up of multiple elements which can be adjusted radially inward and outward with respect to the rotor disk to allow the chokes to be varied depending upon the particular particulate material being transported and metered.

As another feature of the present invention, the outlet of the housing may include a horizontal partition extending between the two sides of the outlet to provide an upper face upon which the solid material rests as it passes through the outlet. The upper face of the horizontal partition has a sufficient surface area and is placed at a location between the top and bottom of the outlet so that the entire outlet is filled with particulate material during pump operation. This feature provides a dam of particles which fills the pump outlet and provides a barrier to prevent the reverse flow of fluids into the pump when the pump is used to discharge material into pressurized systems, such as liquid or gaseous transport pipes.

The uniform and constant flow rate provided by the apparatus in accordance with the present invention make it particularly well suited for use as a metering device. The volume of particulate material being delivered is conventiently and accurately determined by measuring the rational speed of the duct and relating this to the cross-sectional area of the duct. During metering operations, conventional monitoring equipment may be included to ensure that the passageway is full of solids during the metering process.

The above discussed and many other features and attendant advantages of the present invention will become better understood by reference to the following detailed description when considered in conjunction with the accompanying drawings.

DETAILED DESCRIPTION OF THE INVENTION

Figures 1, 2, 3:
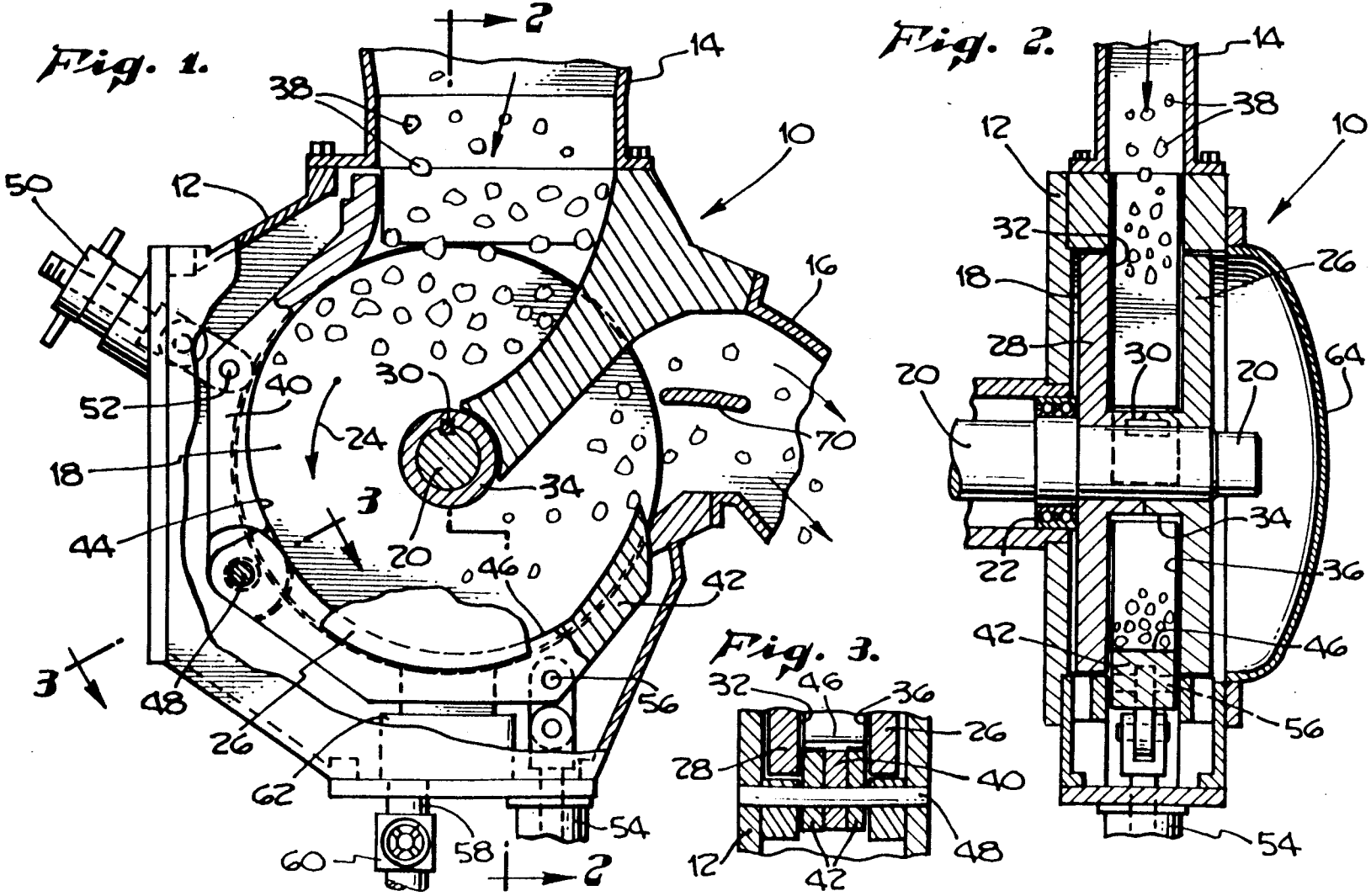
FIG. 1 is a partial sectional side view of a preferred exemplary solids pump in accordance with the present invention wherein the first and second chokes are adjustable.
FIG. 2 is a sectional view of the preferred solids pump of FIG. 1 taken in the 2—2 plane
FIG. 3 is a sectional view of FIG. 1 taken in the 3—3 plane.

A preferred exemplary apparatus in accordance with the present invention is shown generally at 10 in FIGS. 1 and 2. The apparatus 10 includes a housing 12, which includes an inlet 14 and outlet 16. Located within housing 12 is a drive rotor 18. The drive rotor 18 is mounted on shaft 20 with shaft 20 being rotatably mounted within a conventional low-friction bearing assembly 22. The shaft 20 is connected to a hydrostatic or electrically-driven motor (not shown). The shaft 20 is driven by the motor in the direction shown by arrow 24 in FIG. 1.

The drive rotor 18 includes two disks 26 and 28 as best shown in FIG. 2. Each drive disk 26 and 28 forms one-half of the overall drive rotor 18. It is preferred that the drive rotor be made up of two separate drive disks in order to facilitate assembly of the solids pump. Both drive disks 26 and 28 are secured to shaft 20 via a key element 30. The size of the drive rotor 18 may vary widely, depending upon the type and volume of material which is to be transported or metered. Typically, outside diameters for the drive disks 26 and 28 may range from a few inches to many feet. The smaller drive disks are well suited for use in transporting and metering relatively small volumes of solid material such as food additives and pharmaceuticals. The larger size disks may be utilized for transporting and metering large amounts of both organic and inorganic solid materials, including food stuffs, coal, gravel and the like. The apparatus is equally well suited for tranporting and metering large and small particles and mixtures of them, and large and small volumes, and may be used to transport and meter both wet and dry particulate material with the only limitation being that the material cannot be so wet that viscous forces dominate so as to disturb bridging.

As best shown in FIG. 2, the interior surfaces of the drive rotor 18 include a left side surface or wall 32, bottom or hub 34, and right side surface or wall 36. The two side walls 32 and 36 must be located opposite each other in order to provide surfaces between which the particulate solids are compacted during choking. This compaction results in bridging of the particles which is necessary for the pump to operate. It should be noted that other opposing wall configurations are possible. However, the use of radially extending walls 32 and 36 as shown in FIGS. 1 and 2 is preferred. The two side walls 32 and 36, along with hub 34, which engages the solid material 38 is frictionally driven from the inlet 14 to the outlet 16.

The apparatus 10 includes two exterior shoes 40 and 42. The exterior shoes 40 and 42 are designed to fit between the left side wall 32 and right side wall 36 of the drive rotor 18 as best shown in FIGS. 2 and 3. Each of the exterior shoes 40 and 42 includes a stationary inner wall 44 and 46, respectively. Both exterior shoes 40 and 42 are mounted to the housing by way of a pivot pin 48. A screw adjuster 50 is connected to the upper shoe 40 as shown at 52. The screw adjuster 50 is designed to provide radially inward and outward adjustment of shoe 40 about pivot pin 48. As will be described in more detail below, the inward and outward adjustment of shoe 40 allows one to set up a first choking or compaction of the solids as they move through the pump. A second screw adjuster 54 is attached to the lower shoe 42 as shown at 56. The second screw adjuster 54 is of the same type as screw adjuster 50 and is provided to allow inward and outward radial adjustment of shoe 42. The inward and outward adjustment of shoe 42 allows the size of the duct to be varied as the solids move through the pump after passing the first shoe 40.

A dust drain 58 with an associated valve 60 is provided at the bottom of the housing for allowing dust which may collect during pump operation to be removed. The valve 60 may be left open during pump operation to continually remove dust as it falls into the drain through interior collection channel 62. Alternatively, the valve 60 may be left closed and only opened when the collection channel 62 has filled with dust. The opening and closing of the valve 60 will, of course, depend upon the dustiness or friability of the particular solid material being transported. A housing cap 64 is also provided to contain dust generated during operation and to prevent contaminants from entering the housing. The housing cap 64 also allows access to the drive rotor 18 for assembly, inspection and disassembly of the unit.

Figure 4:
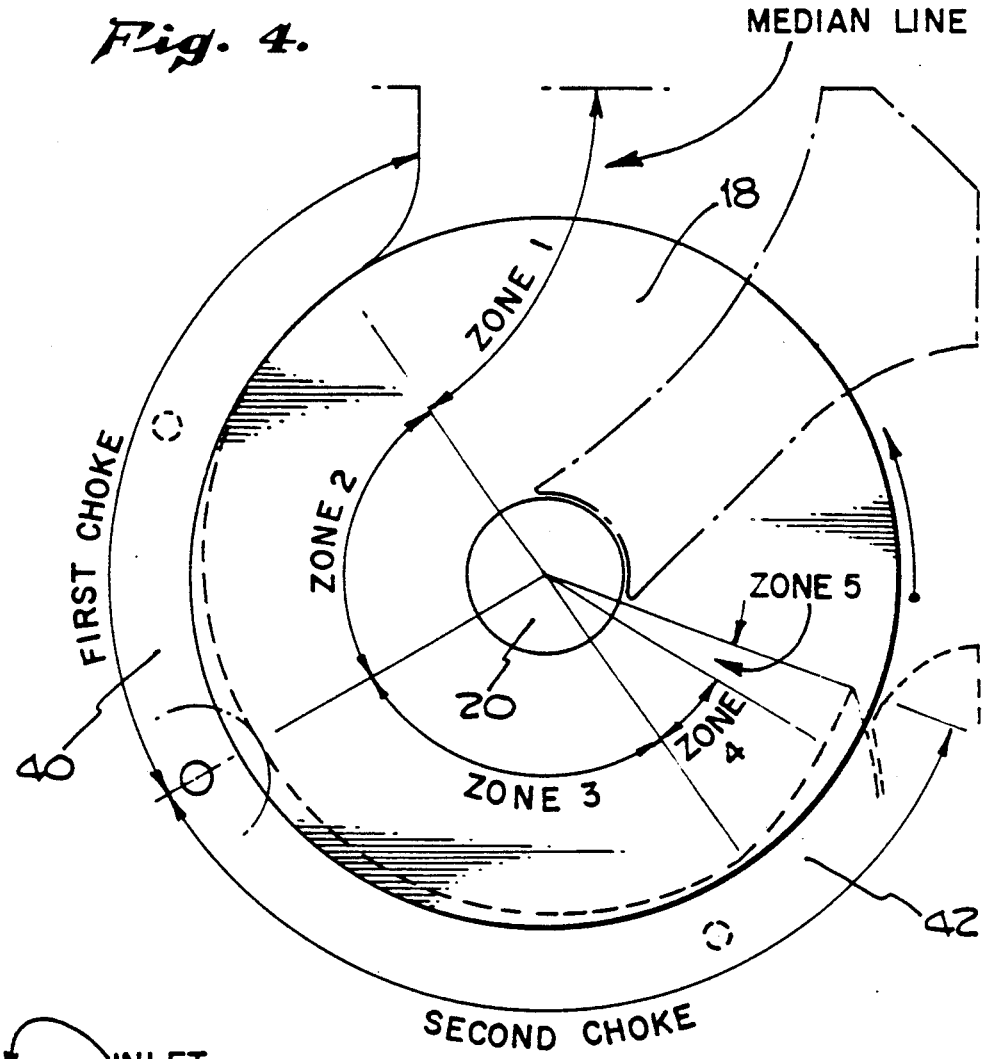
FIG. 4 is a simplified side view of a preferred solids pump in accordance with the present invention which diagrammatically shows the various chokes and zones of convergence and divergence within the pump passageway.
Figure 5:
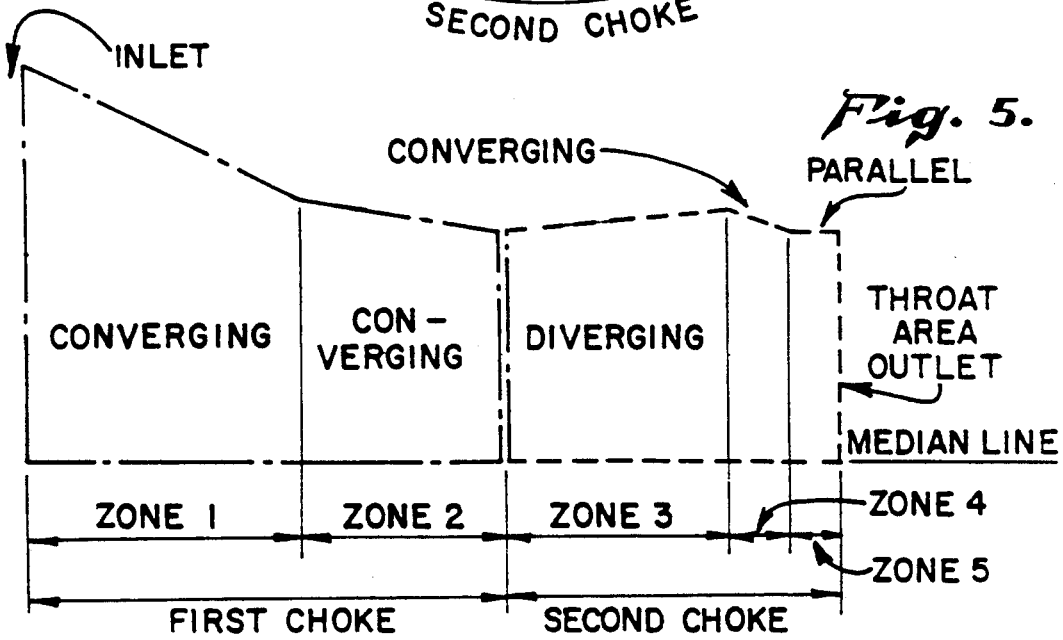
FIG. 5 is a graphic representation showing the variation in throat area with respect to position between the pump inlet and outlet.

Referring to FIGS. 4 and 5, a schematic representation of the drive rotor 18 and exterior shoes 40 and 42 is shown. The duct defined by the interior surfaces of the rotor and the first and second shoe surfaces, is divided into five zones proceeding counterclockwise from the inlet. The surfaces of the first and second shoes are shaped so that the cross-sectional area of the duct converges and diverges as shown in FIG. 4 and as graphically represented in FIG. 5. More specifically, the interior stationary wall or first shoe surface converges toward the hub of the drive rotor as represented by the drop in throat area shown in FIG. 5.

In zone 2, the interior stationary wall 44 of the first shoe continues to converge toward the drive rotor hub. The rate of convergence of the stationary interior wall 44 toward the drive rotor hub in zone 2 is less than that in zone 1. This is a preferred configuration; however, the rate of convergence of the stationary interior wall 44 toward the drive rotor hub may be constant if desired. Zone 2 ends at the downstream end of the first shoe. At this point, the interior stationary wall 44 of shoe 40, in combination with the interior walls of the rotor 18, define the cross-sectional area of the duct.

Downstream from zone 2, the stationary interior surface 46 of the second shoe 42 diverges away from the drive rotor hub 34 so that the duct cross-sectional area increases. The increase in surface area provided by zone 3 releases some of the compaction achieved in zones 1 and 2. This release results in a disturbance of the relationship among the particles which is achieved in the first choke. The degree of release may be varied provided that the divergence of the second shoe 42 in zone 3 does not result in a duct having a cross-sectional area greater than that of the inlet. The stationary interior surface 46 of shoe 42 is shaped so that a recompaction of the particulate material occurs in zone 4 to about the same degree which existed when the solids left zone 2. The particulate material may be recompacted to greater or lesser degrees, if desired, depending upon the particular material being transported and the particular flow characteristics desired. However, in all cases the solids must be compacted to create bridging, disturbed and then recompacted at least once as they are frictionally driven through the pump.

Zone 5 is the final zone that the solids pass through prior to exiting the pump through the outlet. In zone 5, the stationary interior surface of shoe 42 is preferably concentric with the drive rotor so that no change in throat area occurs. Preferably, zones 1 and 2 encompass a longer portion of the circular extent of the duct than do zones 3, 4 or 5. Zones 4 and 5 are preferably much shorter than either zone 1, 2 or 3. The degree to which the particulate material is compacted in the pump will vary widely depending upon the materials being conveyed, pump rotation speed and whether or not the solids are being pumped against a pressure head.

Although the preferred exemplary pump is shown having only two adjustable exterior shoes to control the first and second chokes, other configurations may be utilized wherein more than two exterior shoes are provided so that multiple choking can be carried out. It is preferred that, when using more than two chokes, the chocking alternate between converging and diverging throat areas. A further requirement is that the final choke end with a converging section that recompacts the particulate material prior to passage out of the apparatus outlet.

Once the appropriate cross-sectional areas are established for the chokes, the adjustable shoes are adjusted into place. No further adjustment of the shoes should be necessary provided that the nature and character of the particulate solids being pumped does not change. When it is desired to use the same pump to transport and deliver a variety of different materials, the pump can be set up for each specific material by appropriate adjustment of the shoes 40 and 42.

In an alternate preferred embodiment, the two adjustable shoes 40 and 42 are replaced by a single fixed shoe or housing. The other parts of the pump remain the same. The desired chokes are predetermined for a particular material and incorporated into the fixed housing. The fixed shoe embodiment is well suited for uses where transport and metering is limited to a single type of particulate solids. In such situation, the versality provided by the adjustable shoe embodiment can be avoided in favor of the simplicity of a single integrated fixed housing which is shaped to provide the required two or more chokes in the duct for proper pump operation.

The apparatus in accordance with the present invention may be utilized for transporting particulate material against atmospheric pressure. In addition, the pump has been found useful in pumping solids into pressurized systems. Referring to FIGS. 1 and 2, it is important when pumping solids into pressurized systems that the entire cross-sectional area of outlet 16 be filled with solids pumping. This forms a dam at the pump outlet which is a barrier to possible deleterious effects or reverse flow of gases or liquids back into the pump through the outlet.

In order to ensure that the outlet remains full of solids during transport into a pressurized system, a horizontal partition 70 is provided which extends between the two side walls of the outlet. The partition 70 has a sufficient surface area and is located vertically within the outlet so that solids rest upon the partition as they exist the apparatus. The actual surface area of the horizontal partition 70 must be sufficient so that the angle of repose of a particular material when resting on the partition 70 is such that the portion of the outlet above the partition 70 remains filled during operation. For outlets having large vertical openings, more than one horizontal partition 70 may be utilized depending upon the particular material and its angle of repose. In each case, it is only important that sufficient partitions with sufficient surface area be utilized so that the material, when resting on the partitions and the outlet bottom extend upward to completely fill the outlet opening.

Although the preferred exemplary embodiment is shown utilizing a single drive rotor, it is also possible to provide transport apparatus having multiple drive rotors which receive material from a single or multiple inlets. The use of multiple drive rotors provides for increased material through-put withou having to increase the diameter of the rotor disk.

As previously mentioned, the screw adjusters 50 and 54 are adjusted to achieve desired flow characteristics and pumping conditions provided by the double choking of solids as they move through the passageway. Once the pump is set up for operation, adjustments of the shoe position should not be necessary. If jamming of the pump does occur, the right drive disk 26 may be conveniently removed through the opening covered by housing cap 64. This provides immediate access to the passageway to allow quick clean out of any blockage.

The bridging of solids which occurs in the chokes as the solids pass through the pump results in a positive displacement of the solids. Accordingly, the pump may be used both as a transport and metering device. Due to the positive displacement of solids through the pump, metering is accomplished by measuring the rate of rotation of drive rotor 18 and calculating the amount of solids flow through the pump based upon the cross-sectional area of the duct at its narrowest point. When used as a metering pump, it is desirable that some type of conventional detection device be utilized to ensure that the passageway remains full of solids at all times during solids metering. Such conventional detection devices include gamma ray and electromechanical detectors. These detectors are all well known in the art and are neither shown in the drawings nor described in detail.

The apparatus elements are preferably made of high strength steel or other suitable material. The drive disks and interior walls of the adjustable shoes should be made of a metal or other material which resists abrasion by the material as it is driven through the unit. This is especially true for the adjustable or stationary shoes and their interior faces over which the solid material continually passes.

The apparatus of the present invention is also well suited for metering slugs or plugs of solid material into a flowing pipeline system or other system where discrete repetitive introduction of material is required. The accurate control of transport and metering which is achieved allows pulsed delivered of discrete amounts of particulate material into both pressurized and unpressurized systems.

Having thus described exemplary embodiments of the present invention, it should be understood by those skilled in the art that the above disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. An apparatus for transporting particulate material comprising:

a housing having an inlet, an outlet and a duct between said inlet and outlet, said duct being formed between two opposed friction drive walls movable relative to said pump housing from said inlet towards said outlet and one or more stationary walls fixed relative to said pump housing with respect to movement between said inlet and said outlet, said friction drive walls having a greater surface area for contacting said solid material than said stationary walls;

first choke means for compacting to bridge said particulate material after introduction into said inlet, said first choke means including a convergence of said friction drive walls and said stationary walls to provide a first of said duct having a cross-sectional area which is less than the cross-sectional area of said inlet;

second choke means for disturbing the relationship of said particulate material after said particulate material passes through said first choke means and then recompacting said particulate material, said second choke means including a divergence of said friction drive walls and said stationary walls to provide a second portion of said duct having a cross-sectional area which is greater than the cross-sectional area of said first portion of said duct, but less than the cross-sectional area of said inlet, said second choke means also including a convergence of said friction drive walls and said stationary walls located between said second portion of said duct and said outlet to provide a third portion of said having a cross-sectional area which is less than the cross-sectional area of said second portion of said duct.

2. An apparatus for transporting particulate material according to claim 1 wherein the rate at which said friction drive walls and said stationary wall converge in said first portion varies to provide a first zone and a second zone within said first portion, said first zone having a rate of convergence of said friction drive walls and said stationary wall which is greater than the rate of convergence for said second zone.

3. An apparatus for transporting particulate material according to claim 1 wherein the minimum cross-sectional area of the convergence of said second choke means at said third portion is about equal to the minimum cross-sectional area of the convergence of said first choke means.

4. An apparatus for transporting particulate material according to claim 1 wherein the length of said first choke means is greater than the length of said second choke means.

5. An apparatus for transporting particulate material according to claim 1 wherein the minimum cross-sectional area of the convergence of said first choke is sufficient to provide bridging of said particulate material within said duct.

6. An apparatus for transporting particulate material according to claim 1 wherein said friction drive walls are provided by the interior opposed walls of a U-shaped rotor disc which is rotatable within said housing.

7. An apparatus for transporting particulate material according to claim 1 wherein said friction drive walls are provided by the interior opposed walls of a plurality of U-shaped rotor disc which are rotatable within said housing.

8. An apparatus for transporting particulate material according to claim 1 wherein said outlet is defined by a top, a bottom and two sides, said apparatus including a horizontal partition extending between said two sides and spaced between said top and bottom, said horizontal partition including an upper face upon which said solid material rests prior to existing said outlet.

9. An apparatus for conveying solid material according to claim 6 wherein said rotor disc is fixed laterally relative to said housing and said stationary wall is movable laterally relative to said rotor disc to vary the cross-sectional areas of said first and second choke means.

10. An apparatus for transporting particulate material according to claim 1 further including means for measuring the flow of solids through said duct.

11. A process for transporting particulate material comprising the steps of:

feeding particulate material into an inlet end of a duct formed between two opposed friction drive walls and a stationary wall or walls, said friction drive walls having a greater surface area of contacting said particulate material than said stationary walls;

moving said friction drive walls toward an outlet end of said duct;

compacting said particulate material in a first portion of said duct by converging said stationary walls with respect to said friction drive walls to form bridged particulate material in said duct;

disturbing the relationship of the particulate material by diverging said stationary walls with respect to said friction drive walls in a second portion of said duct to form disturbed particulate material; and recompacting said disturbed particulate material by converging said stationary wall with respect to said friction drive walls in a third portion of said duct.

12. A process for transporting particulate material according to claim 11 wherein the rate at which said friction drive walls and said stationary wall converge in said first portion varies to provide a first zone and a second zone within said first portion, said first zone having a rate of convergence of said friction drive walls and said stationary wall which is greater than the rate of convergence for said second zone.

13. A process for transporting particulate material according to claim 11 including the step of measuring the flow of solids passing through said duct.

14. A process for transporting particulate material according to claim 11 wherein said friction drive walls are provided by the interior opposed walls of a U-shaped rotor disc.

15. A process for transporting particulate material according to claim 11 wherein the drive walls are provided by the interior opposed walls of a plurality of U-shaped rotor discs.

* * * * *

UNITED STATES PATENT AND TRADEMARK OFFICE

CERTIFICATE OF CORRECTION

PATENT NO. : 4,988,239

DATED : January 29, 1991

INVENTOR(S) : Donald Firth

It is certified that error appears in the above-identified patent and that said Letters Patent is hereby corrected as shown below:

Title Page:

Abstract, line 7, the word "from" should be changed to --form--.

In col. 3, line 58, the word "rational" should be --rotational--.

In col. 4, line 8, at the end of the sentence a period should be added after the word "plane".

In col. 7, line 1, after the word "solids" the word --during-- should be inserted.

In col. 7, line 2, the word "or" should be --of--.

In col. 7, line 10, the word "exist" should be --exit--.

In col. 7, line 28, the word "withou" should be --without--.

In col. 7, line 35, the word "position" should be --positioning--.

In col. 8, line 1, the word "delivered" should be --delivery--.

In col. 8, line 30, after the word "first", the word --portion-- should be inserted.

In col. 8, line 46, after the word "said", the word --duct-- should be inserted.

In col. 9, line 12, the word "disc" should be --discs--.

In col. 9, line 20, the word "existing" should be --exiting--.

UNITED STATES PATENT AND TRADEMARK OFFICE

CERTIFICATE OF CORRECTION

PATENT NO. : 4,988,239

DATED : January 29, 1991

INVENTOR(S) : Donald Firth

It is certified that error appears in the above-identified patent and that said Letters Patent is hereby corrected as shown below:

In col. 10, line 1, the word "of" should be changed to --for--.

Signed and Sealed this

Seventeenth Day of November, 1992

*Attest:*

DOUGLAS B. COMER

*Attesting Officer*

*Acting Commissioner of Patents and Trademarks*